US007338386B2

(12) United States Patent
Nakajima

(10) Patent No.: US 7,338,386 B2
(45) Date of Patent: Mar. 4, 2008

(54) GOLF CLUB SHAFT

(75) Inventor: Yoshifumi Nakajima, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/362,806

(22) Filed: Feb. 28, 2006

(65) Prior Publication Data

US 2007/0117647 A1 May 24, 2007

(30) Foreign Application Priority Data

Nov. 21, 2005 (JP) ..... 2005-335394

(51) Int. Cl.
*A63B 53/10* (2006.01)

(52) U.S. Cl. ..... 473/319

(58) Field of Classification Search ..... 473/316–323, 473/292

See application file for complete search history.

(56) References Cited

U.S. PATENT DOCUMENTS 5,451,056 A * 9/1995 Manning ..... 473/328
5,569,097 A * 10/1996 Veux et al. ..... 473/292
6,273,830 B1 * 8/2001 Takemura et al. ..... 473/319
6,863,623 B2 * 3/2005 Oyama ..... 473/319
6,929,562 B2 * 8/2005 Kumamoto ..... 473/319
7,077,761 B2 * 7/2006 Nishio ..... 473/314
2003/0125125 A1 * 7/2003 Oyama ..... 473/323
2006/0009302 A1 * 1/2006 Oyama ..... 473/282
2006/0073905 A1 * 4/2006 Oyama ..... 473/316

FOREIGN PATENT DOCUMENTS

JP 10-155952 * 10/1998
JP 2000-14844 A 1/2000
JP 2002-282399 A 10/2002

* cited by examiner

*Primary Examiner*—Stephen Blau
(74) *Attorney, Agent, or Firm*—Sughrue Mion, PLLC

(57) ABSTRACT

A light-weighted golf club shaft, which can stabilize the swing orbit of a club head during a swing and can allow a player to swing a golf club easily and to have a consistent shot pattern, is provided. The golf club shaft has a length of 42 to 48 inches and a weight of 35 to 50 grams. A center of gravity of the shaft is located within 46.0 to 49.0% of its entire length from its tip end and a torque to the tip-end of the shaft ranges between 3.0 and 4.5 degrees. The shaft may comprise a longitudinal layer and a biased layer. The biased layer may comprise carbon fibers having a modulus of elasticity of not less than 40 t/mm$^2$. The ratio of the number of turns of prepreg sheets for the biased layer in the tip-end portion to that in the butt-end portion of the shaft may range between 3:1 and 3:2.

6 Claims, 3 Drawing Sheets

GOLF CLUB SHAFT

BACKGROUND OF THE INVENTION

The present invention relates to a golf club shaft made of fiber-reinforced-plastic (FRP).

A golf club shaft is generally constructed such that a plurality of prepreg sheets of carbon fiber-reinforced plastic (CFRP) are rolled onto an elongated mandrel to form a rolled assembly of sheets which is heat-treated to cure and form a hollow shaft from which the mandrel is removed. The prepreg sheet is made from unidirectional carbon fibers and the golf club shaft generally comprises longitudinal layers containing fibers oriented approximately parallel to a longitudinal axis of the shaft and biased layers containing fibers oriented at a substantial angle transverse to the longitudinal axis of the shaft.

Such carbon shaft is lighter than a steel shaft. Further, much attention has been focused on a reduction in the number of turns of prepreg sheets, in order to provide a lighter carbon shaft. However, simply reducing the number of turns of prepreg sheets causes a player to only feel the club is light without sensing the weight of the club head at the end of the shaft. This leads to a problematic situation where the swing orbit of a club head during a player's swing is destabilized and the player is not able to swing a golf club easily and/or has an inconsistent shot pattern.

Japanese Unexamined Patent Publication No. 2000-14844 discloses a light-weighted golf club shaft in which a biased layer is formed by using a prepreg sheet of super-elastic alloy fibers to achieve a longer driving distance and to give a player a lot more consistent shot pattern. Japanese Unexamined Patent Publication No. 2002-282399 discloses a golf club shaft which is constructed so that a hoop layer containing fibers oriented perpendicular to a longitudinal axis of the shaft is formed in the butt-end portion of the shaft to allow the shaft to have high collapse resistance and allow a player to have a good feel for the shaft and a longer driving distance

SUMMARY OF THE INVENTION

In consideration of the above-mentioned problems, the present invention is intended to provide a light-weighted golf club shaft, which stabilizes the swing orbit of a club head and allows a player to swing the golf club easily and to have a consistent shot pattern.

In order to achieve the above object, a golf club shaft according to the invention has a length of 42 to 48 inches and a weight of 35 to 50 grams, wherein the center of gravity of the shaft is located within 46.0 to 49.0% of its entire length from its tip end, and a torque to the tip-end of the shaft ranges between 3.0 and 4.5 degrees.

The golf club shaft according to the invention may comprises a longitudinal layer and a biased layer, wherein the biased layer may comprise carbon fibers having a modulus of elasticity of not less than 40 t/mm$^2$, and the ratio of the number of turns of a prepreg sheet for forming the biased layer in the tip-end portion to that in the butt-end portion of the shaft may range between 3:1 and 3:2, and preferably between 3:1 and 2:1.

In this way, according to the invention, even if a golf club shaft is reduced in weight, by shifting the center of gravity of the shaft closer to the tip end of the shaft than that of the prior art golf club shaft, i.e., within 46.0 to 49.0% of the entire length of the shaft from the tip end of the shaft, and by decreasing the torque to the tip-end of the shaft to be smaller than that of the prior art golf club shaft, i.e., down to 3.0 to 4.5 degrees, it is possible to provide a light-weighted golf club shaft that can stabilize the swing orbit of a club head during a swing and can allow a player to have a good feel for a golf club during a swing and to have a consistent shot pattern.

Hereinafter, embodiments of a golf club shaft according to the invention will be explained with reference to the accompanying drawings.

DETAILED DESCRIPTION OF THE PREFERRED EMBODIMENT

Figure 1:
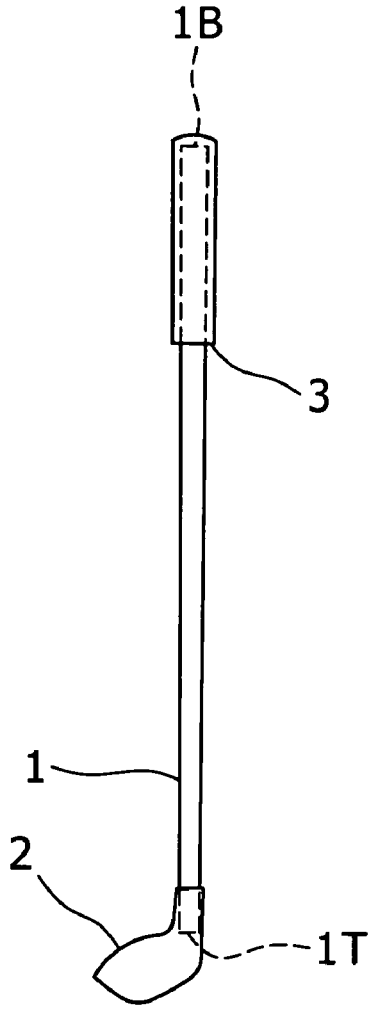
FIG. 1 is a schematic view of an embodiment of a golf club shaft according to the invention.

As shown in FIG. 1, a golf club shaft 1 is in the shape of a cylinder having a diameter that reduces with increasing distance from the butt end 1B to the tip end 1T of the shaft. A club head 2 is secured to the tip end 1T of the shaft 1 and a grip 3 is placed over the butt end 1B of the shaft. Preferably, the shaft 1 is between 42.5 and 44.5 inches (1080 and 1130 mm) in total length, has an outer diameter of 14.0 to 16.0 mm at its butt end and an outer diameter of 8.5 to 9.5 mm at its tip end, and is between 35 and 50 grams in weight.

The shaft 1 is preferably formed from multiple layers of fiber-reinforced plastic (FRP). Examples of fibers in the fiber-reinforced plastic include carbon fibers alone, composite fibers comprising carbon fibers and other material fibers, metal fibers and the like. Further, examples of matrix resin include thermosetting resin such as epoxy resin.

Figure 2:
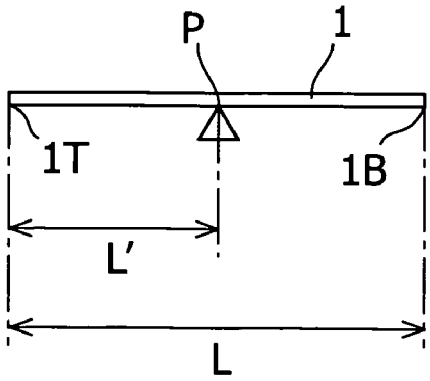
FIG. 2 is a schematic view to explain how to measure the center of gravity of the shaft.

The shaft 1 has the center of gravity located within 46.0 to 49.0% of its entire length from its tip end. The center of gravity P is a single point at which the shaft 1 is substantially horizontally supported, as shown in FIG. 2. The position of the center of gravity P is represented by a percentage ratio of a distance L' from the tip end IT to the center of gravity of the shaft with respect to an entire length L of the shaft 1 (i. e., center of gravity P (%)=L'/L* 100). It has been experimentally observed that when a shaft is light weighed and weighs from 35 to 50 grams, the shaft has the center of gravity located within about 51 to 55% of its entire length from its tip end. By contrast, the shaft according to the invention has the center of gravity located much closer to its tip end, i.e., located within 46.0 to 49.0% of its entire length from its tip end. It is more preferred that the shaft has the center of gravity located within 47.0 to 48.0% of its entire length from its tip end.

Figure 3:
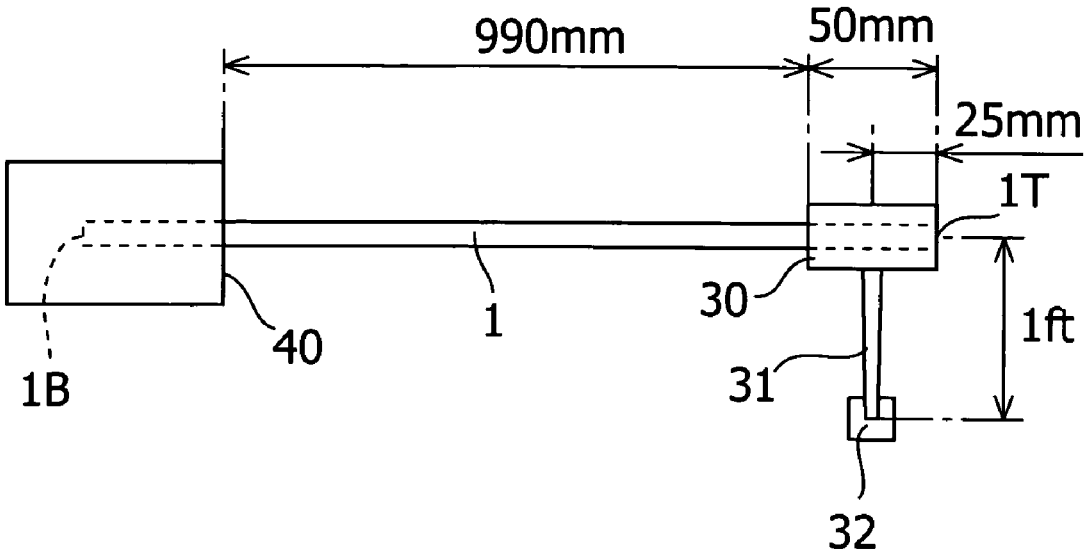
FIG. 3A is a plan view to explain how to measure the torque of the shaft.
FIG. 3B is a perspective view to explain how to measure the torque of the shaft.
Figure 3:
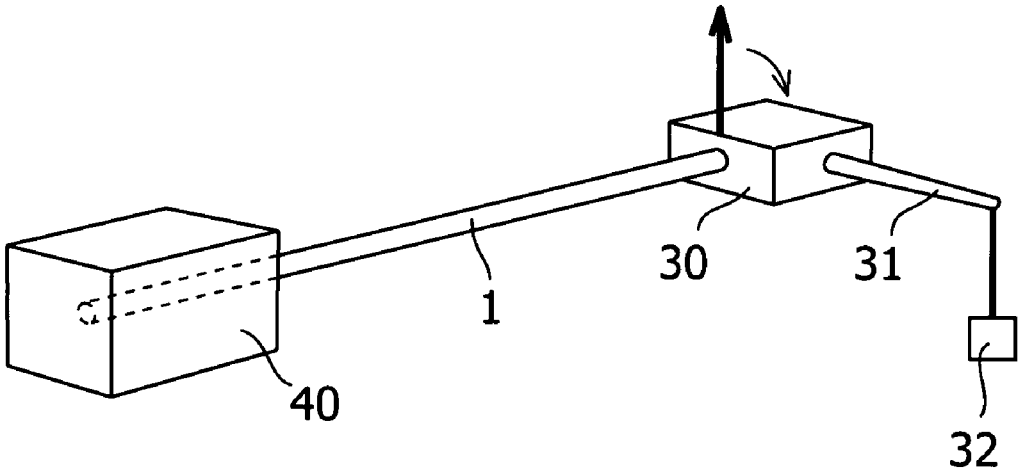

The torque to the tip-end of the shaft 1 is between3.0 and4.5 degrees. FIGS. 3(*a*) and (*b*) explain how the torque to the tip-end of the shaft is measured. A portion of the shaft 1 located at a distance of 1040 mm from the tip end up to the butt end along the shaft is fixed to a fixing member 40 and a tool 30 is attached to a portion of the shaft located at a distance of up to 50 mm from the tip end along the shaft. An arm 31 with a length of 1 foot is attached to the tool 30 at a distance of 25 mm from the tip end of the shaft 1 in a direction transverse to the direction of the length of the shaft and an object 32 with a weight of 1 pound is attached to the tip end of the arm 31. Accordingly, when a one foot pound (13.83 kgcm) of force is applied at a distance of 25 mm from the tip end of the shaft 1, the shaft is twisted. The angular rotation of the shaft is measured at a distance of 50 mm from the tip end of the shaft 1. The angular rotation of the shaft is equal to the torque applied to the tip end of the shaft. It has been experimentally observed that when a shaft is light weighed and weighs from 35 to 50 grams, the torque to the tip-end of the shaft is about 5.5 to 8 degrees, however, according to the invention, the torque to the tip-end of the shaft is reduced down to 3.0 to 4.5 degrees. Taking into account the fact that reducing the torque to the tip-end of the shaft to the extremely small value reduces the strength of the shaft, it is preferred that the torque to the tip-end of the shaft is 4.0 to 4.5 degrees.

In this way, even if a shaft is light weighed and weighs from 35 to 50 grams, when the shaft has the center of gravity located within 46.0 to 49.0% of its entire length from its tip end and the torque to the tip-end of the shaft 1 is reduced down to 3.0 to 4.5 degrees, it becomes possible that the swing orbit of the club head during a swing is stabilized and a player has good feel for the golf club during a swing, and further has a consistent shot pattern. On the other hand, when the shaft has the center of gravity located more than 49.0% of its entire length from its tip end or the torque to the tip-end of the shaft is over 4.5 degrees, a player only feels the lightness of the golf club, cannot feel the force in the club head, and feels uncomfortable during a swing, and further cannot have a consistent shot pattern. Accordingly, a player using such a shaft cannot benefit from the advantages of the invention.

Figure 4:
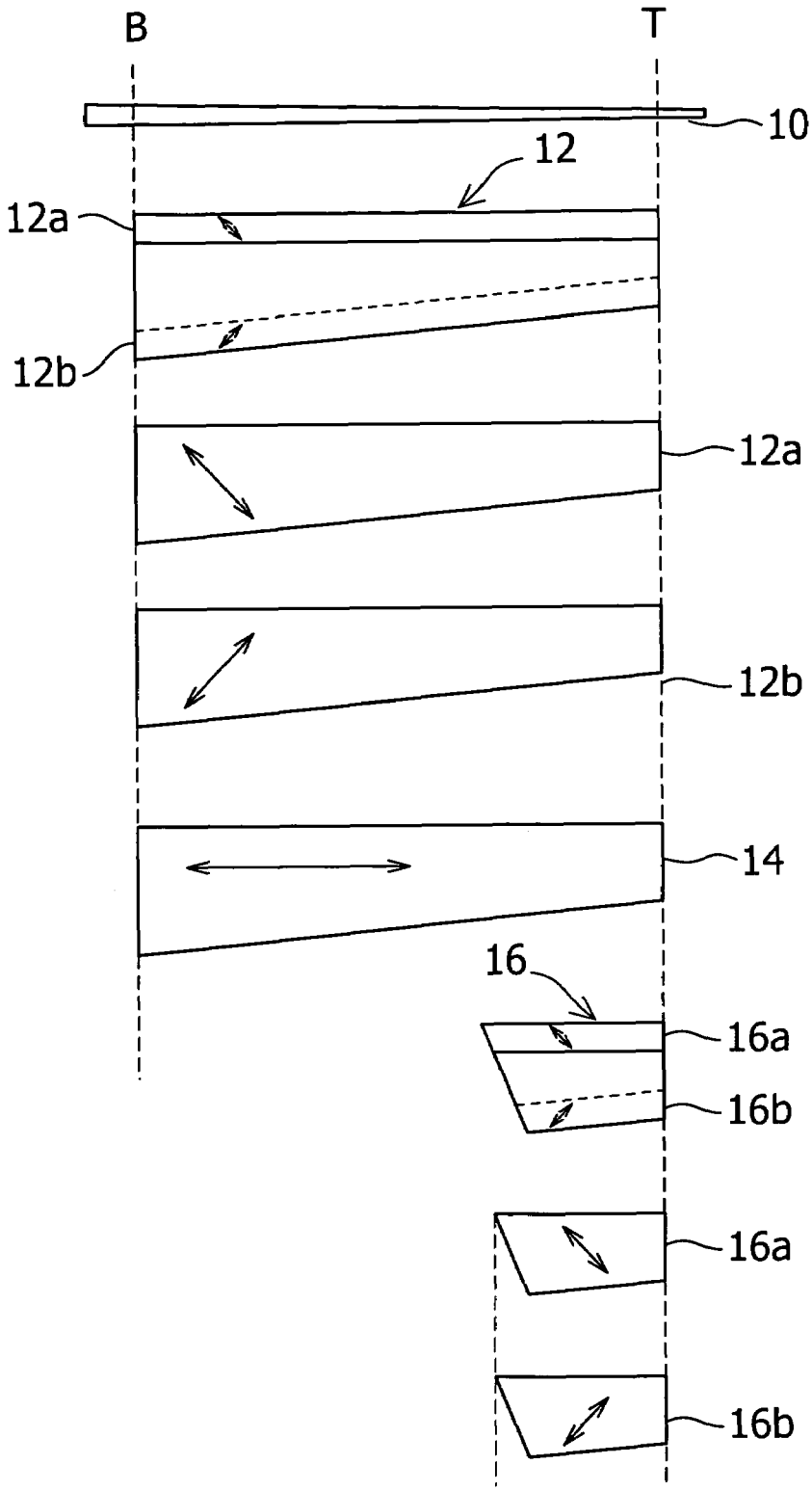
FIG. 4 is a plan view showing an embodiment of a mandrel and various prepreg sheets used to make the golf club shaft according to the invention.

Next, a method for producing a golf club shaft having the center of gravity located at a predetermined location along the length of the shaft and a predetermined amount of torque to the tip-end of the shaft will be explained below. A shaft according to the invention is constructed so that a plurality of sheets is rolled onto a mandrel to form a rolled assembly of sheets. FIG. 4 is a plan view showing a mandrel and a plurality of prepreg sheets used in a method for producing a golf club shaft according to the invention.

As shown in FIG. 4, a mandrel 10 functions as a mold having the desired shape of the interior of the finished golf club shaft. The mandrel 10 has the shape of the interior of the finished shaft and is in the shape of a cylinder having a diameter that reduces with increasing distance from the butt end to the tip end of the shaft.

Prepreg sheets 12, 14, 16 are made from carbon fibers that are pre-impregnated in a resin matrix and are heat-treated to cure and form a carbon fiber reinforced plastic constituting a golf club shaft. The prepreg sheet is made from unidirectional carbon fibers and the orientation of the carbon fibers is parallel to the direction of arrows in FIG. 4.

The prepreg sheet 12 for biased layer contains carbon fibers oriented at a substantial angle transverse to the longitudinal axis of the shaft and preferably, the angle of the orientation of fibers with respect to the longitudinal axis of the shaft (hereinafter, referred to as fiber orientation angle) is 45±5 degrees. The prepreg sheet 12 for biased layer is the same length as the entire length of the shaft. Further, the prepreg sheet 12 for biased layer is shaped like a trapezoid so as to allow the sheet to be wrapped uniformly around the mandrel 10 with a predetermined number of turns because the mandrel 10 is tapered from its butt end to tip end. The prepreg sheet 12 for biased layer is constructed so that the angles of the fibers in two prepreg plies 12*a*, 12*b* are symmetrical with reference to the longitudinal axis of the mandrel and the two plies are attached together in an overlapping fashion to form a single sheet. The two plies may be attached together so as to allow the one to be aligned with a zero-degree position of rotation on the mandrel and the other to be aligned with a 180-degree position of rotation on the mandrel, as shown in FIG. 4.

The prepreg sheet 14 for longitudinal layer contains carbon fibers oriented approximately parallel to a longitudinal axis of the shaft. That is, the fiber orientation angle of this sheet 14 is 0±5 degrees. The prepreg sheet 14 for longitudinal layer is the same length as the entire length of the shaft and further is shaped like a trapezoid so as to allow the sheet to be wrapped uniformly around the mandrel 10 with a turn. It is preferred that carbon fibers in the prepreg sheet 14 for longitudinal layer have a modulus of elasticity of not less than 24 t/mm$^2$, especially of 24 to 40 t/mm$^2$.

The additional prepreg sheet 16 for biased layer contains carbon fibers oriented at a substantial angle transverse to the longitudinal axis of the shaft and preferably, the fiber orientation angle of the sheet 16 with respect to the longitudinal axis of the shaft is 45±5 degrees, similar to the prepreg sheet 12 for biased layer. However, the length of the additional prepreg sheet 16 is 15 to 25% of the entire length of the shaft (e. g., equal to 170 to 285 mm when the entire length of the shaft is 1145 mm). The additional prepreg sheet 16 for biased layer is also constructed so that the angles of the fibers in two additional prepreg plies 16*a*, 16*b* are symmetrical with reference to the longitudinal axis of the mandrel and the two plies are attached together in an overlapping fashion to form a single csheet. The two plies may be attached together so as to allow the one to be aligned with a zero-degree position of rotation on the mandrel and the other to be aligned with a 180-degree position of rotation on the mandrel, as shown in FIG. 4.

The additional prepreg sheet 16 for biased layer may be constructed so that the sheet is of such a width to allow the biased ply 16 to be shaped like a trapezoid so as to allow the sheet to be wrapped uniformly around the mandrel 10 with a predetermined number of turns, similar to the prepreg sheets mentioned above. However, as shown in FIG. 4, the additional prepreg sheet 16 may be shaped so that a portion of the trapezoid on the lower base side is cut off at a slant. This shape causes the thickness of the biased layer to be gradually increased in the direction of the axis of the shaft. Accordingly, the torque to the tip-end of the shaft is reduced, the center of gravity of the shaft is located on the side of the tip end of the shaft, and undue stress on the tip end is prevented.

It is preferred that carbon fibers in the prepreg sheet 12 and the additional prepreg sheet 16 for biased layers have a modulus of elasticity of not less than 40 t/mm$^2$. When carbon fibers having a modulus of elasticity of not less than 40 t/mm$^2$ are distributed within a biased layer, the ratio of the number of turns of biased plies in the tip-end portion to that in the butt-end portion of the shaft can be set to be a predetermined value, whereby it is possible to adjust the center of gravity of the shaft and the torque to the tip-end of the shaft so as to take on a predetermined range of values. When the modulus of elasticity is too high, the strength of the shaft is reduced and the shaft breaks more easily. Accordingly, it is more preferable to use carbon fibers having a modulus of elasticity of 40 to 46 t/MM$^2$.

A method for forming a club shaft using the above-mentioned mandrel and prepreg sheets will be explained below. First, the prepreg sheet 12 for biased layer is rolled onto the mandrel 10. It is preferred that the prepreg sheet 12 for biased layer is wrapped 4 to 6 turns around the mandrel 10. When the prepreg sheet 12 for biased layer is constructed so that the angles of the fibers in two prepreg plies are symmetric with reference to the longitudinal axis of the mandrel and the two plies are attached together in an overlapping fashion, a locally increased stiffness in a circumferential direction of the shaft can be reduced and the torque of the shaft can be reduced.

Further, a sheet containing fibers oriented at zero-degree transverse to the longitudinal axis of the shaft is rolled onto the mandrel as an outer sheet. This acts to prevent the shaft from having a locally increased thickness and an anisotropy in a circumferential direction. The prepreg sheet 14 for longitudinal layer is rolled onto the mandrel on top of the prepreg sheet 12 for biased layer. It is preferred that the prepreg sheet 14 for longitudinal layer is wrapped 3 to 8 turns around the mandrel on top of the prepreg sheet 12 for biased layer. Further, the additional prepreg sheet 16 for biased layer is aligned with the tip end of the shaft and rolled onto the mandrel on top of the prepreg sheet 14 for longitudinal layer. By aligning the additional prepreg sheet 16 for biased layer with the tip end of the shaft in this way, it is possible to change the number of turns of prepreg sheets for forming biased layers on between the tip-end portion and the butt-end portion of the shaft (e. g., when one prepreg sheet is rolled 3 turns onto the mandrel, the number of turns of prepreg sheets is three and when two prepreg sheets are each rolled 3 turns onto the mandrel, the number of turns of prepreg sheets is six).

It should be noted that the term "butt-end portion of shaft" used to determine the number of turns of sheets means a portion located within 75 to 100% of the entire length of the shaft from the tip end of the shaft and the term "tip-end portion of shaft" means a portion located within 0 to 15% of the entire length of the shaft from the tip end of the shaft. For example, when the entire length of the shaft is 1145 mm, "butt-end portion of shaft" is positioned over a range of 858 to 1145 mm from the tip end and "tip-end portion of shaft" is positioned over a range of 0 to 170 mm from the tip end.

Preferably, the ratio of the number of turns of prepreg sheets for forming biased layers in the tip-end portion to that in the butt-end portion of the shaft may ranges between 3:1 and 3:2. The ratio between 3:1 and 3:2 allows the shaft to have the center of gravity located within 46.0 to 49.0% of its entire length from its tip end and the torque to the tip-end of the shaft to be reduced down to 3.0 to 4.5 degrees, even if the shaft is light weighted and weighs from 35 to 50 grams. It should be noted that when the ratio of the number of turns of prepreg sheets in the tip-end portion to that in the butt-end portion of the shaft is significantly above 3, further problems are encountered in forming a club shaft. More preferably, the ratio of the number of turns of prepreg sheets in the tip-end portion to that in the butt-end portion of the shaft may range between 3:1 and 2:1.

It should be noted that although the additional prepreg sheet 16 for biased layer is rolled onto the mandrel on top of the rolled subassembly constructed of the prepreg sheet 12 for biased layer and the prepreg sheet 14 for longitudinal layer in the case described above, the additional prepreg sheet 16 for biased layer may be rolled onto the mandrel and sandwiched between the prepreg sheets 12 for biased layer, or sandwiched between the prepreg sheet 12 for biased layer and the prepreg sheet 14 for longitudinal layer, or sandwiched between the prepreg sheets 14 for longitudinal layer.

It should be appreciated that the ratio of the number of turns of prepreg sheets for forming longitudinal layer in the tip-end portion to that in the butt-end portion of the shaft is 1:1 because only the prepreg sheet 14 of the same length as the entire length of the shaft is used for the longitudinal layer. However, the ratio of the number of turns of prepreg sheets for forming longitudinal layer in the tip-end portion to that in the butt-end portion of the shaft can also be varied using an additional prepreg sheet containing fibers oriented approximately parallel to the longitudinal axis, as long as the shaft has the center of gravity located within 46.0 to 49.0% of its entire length its tip end and the torque to the tip-end of the shaft is set to 3.0 to 4.5 degrees.

In this way, the prepreg sheets 12, 14, 16 are rolled onto the mandrel 10 in the order of these sheets to form a rolled subassembly of sheets. The rolled subassembly is placed in an oven to cure the resin of the prepreg sheets and fuse together the sheets of the rolled assembly. Then, the mandrel is removed from the rolled assembly to produce a resulting golf club shaft which is integrally formed from carbon fiber reinforced resin.

EXAMPLES

A golf club shaft was constructed as follows. At first, a single prepreg sheet for biased layer was rolled three turns onto a mandrel having an outer diameter of 4.9 mm in the tip-end and an outer diameter of 13.0 mm in the butt-end, a single prepreg sheet for longitudinal layer was rolled two turns onto the mandrel, and then a single additional prepreg sheet for biased layer being trapezoid in shape and having a length of 280 mm was rolled six turns onto the mandrel in the tip-end of the shaft, thereby forming a rolled assembly of sheets. Afterwards, the rolled assembly of sheets was placed in an oven to heat and cure the resin of the prepreg sheets. Finally, the mandrel was removed from the rolled assembly of sheets, thereby providing a golf club shaft having a length of 1145 mm. Further, two other golf club shafts were constructed in the same manner as described above, except that the additional prepreg sheet biased layer was slightly differently shaped or the number of turns of the prepreg sheets was reduced. It should be noted that carbon fiber prepreg sheets (with a modulus of elasticity of 40 $t/mm^2$) were used as the prepreg sheets and that a single prepreg sheet for biased layer was formed so that one of two prepreg plies having a fiber orientation angle of 45 degrees and the other of the two plies having −45 degrees were attached together.

For three types of club shafts (examples 1 to 3) constructed as described above, the weight, the center of gravity, and the torque to the tip-end of the shaft were measured. The results from the measurement are shown in table 1. Further, for comparison purposes, the same measurement was performed on a test club shaft (example 4) as well as a commercially available club shaft (example 5). In this case, the test club shaft (example 4) was constructed so that the ratio of the number of turns of prepreg sheets for forming biased layer in the tip-end portion to that in the butt-end portion of the shaft was 1:1. The results from the measurement are shown in table 1.

TABLE 1

| Example | Weight [g] | Torque [degrees] | Center of gravity [%] |
|---|---|---|---|
| 1 | 45.4 | 4.1 | 48.2 |
| 2 | 47.2 | 4.5 | 48.3 |
| 3 | 38.0 | 4.5 | 48.5 |
| 4 | 45.5 | 4.8 | 47.8 |
| 5 | 49.3 | 4.7 | 49.4 |

Further, a driver was constructed so that a club head and a grip (Tour Stage (trade name) by Bridgestone Sports Co., Ltd.) were attached to the each club shaft of examples 1, 2, 4, and 5 and then human testers hit golf balls with the drivers of those examples and had their swing tested for the following items. Measurement of swing characteristics and ball speed was made using Science Eye (trade name) manufactured by Bridgestone Sports Co., Ltd. The results from the measurement are shown in table 2. It should be noted that the values for the results were calculated by averaging the readings taken during a trial at which four testers each hit five golf balls with each of the drivers. Further, the rank for "ease of swing" was determined by assigning relevance scores to testers' evaluations and comparing those scores with one another. The evaluation items included: 1) how the club feels when you swing it—heavy or light; 2) smoothness of swing; 3) ease of getting the right swing timing for where a golf ball is going to be at moment of contact; 4) ease of increasing the turning tendency of the club head during an impact; 5) whether or not you get any weighted head feel during a swing; 6) stability of club head during a swing; and 7) the degree of benefit from a club head, and those items were scored in four grades.

TABLE 2

| Example | Head speed [m/s] | Initial speed [m/s] | Smash factor [–] | Launch angle Upper | Launch angle Left/Right | Spin amount [rpm] Back | Spin amount [rpm] Side | Horizontal displacement [yds] | Driving distance [yds] Carry | Driving distance [yds] Total | Rank for ease of swing |
|---|---|---|---|---|---|---|---|---|---|---|---|
| 1 | 44.6 | 61.0 | 1.368 | 11.8 | 1.3 | 2329 | −49 | 3.1 | 208.8 | 232.8 | 2 |
| 2 | 45.0 | 61.5 | 1.367 | 12.3 | 1.1 | 2307 | −24 | 3.0 | 211.3 | 234.6 | 1 |
| 4 | 44.8 | 60.9 | 1.359 | 12.6 | 2.1 | 2088 | −74 | 5.8 | 205.8 | 232.1 | 3 |
| 5 | 44.4 | 60.5 | 1.363 | 12.5 | 3.2 | 2741 | 300 | 22.5 | 207.8 | 229.0 | 4 |

As shown in Table 2, in the case of the drivers using the shafts of the examples 1, 2 having a weigh from 45 to 50 grams, the center of gravity of about 48%, and the torque to the tip-end of 4.1 to 4.5 degrees, it was fair to assume that the initial ball launch speed was high, smash factor (i.e., ratio of initial ball launch speed divided by club head speed) was high, and the driver was easy to swing. Further, the human testers gave high scores to ease of swing. Additionally, since the initial ball launch speed and the smash factor were high, the human testers' driving distance increased. Moreover, the launch angle either to left or right, the sidespin amount, and the horizontal displacement were all small and the shot pattern was extremely consistent.

In the case of the drivers using the shaft of the example 4 having the center of gravity of 47.8% but high torque to the tip-end of 4.8 degrees, or the shaft of the example 5 having the center of gravity of 49.4% (i.e., located closer to its butt end) and high torque to the tip-end of 4.7 degrees, it was fair to assume that the initial ball launch speed was low and the smash factor was low, and therefore the human testers' driving distance did not improve so much. Further, the human testers gave low scores to ease of swing. Additionally, the launch angle either to left or right, the sidespin amount, and the horizontal displacement were all large, and the shot pattern was also inconsistent.

What is claimed is:

1. A golf club shaft having a length of 42 to 48 inches and a weight of 35 to 50 grams, wherein a center of gravity of the shaft is located within 46.0 to 49.0% of its entire length from its tip end and a torque to the tip-end of the shaft ranges between 3.0 and 4.5 degrees, wherein the torque to the tip-end of the shaft is measured by measuring the angular degree of twisting caused by fixing the golf club shaft at 1040 mm from the tip-end toward a butt-end and applying a 1 foot-pound of torque to a position on the golf club shaft 25 mm from the tip-end.

2. The golf club shaft according to claim 1, wherein the shaft comprises a longitudinal layer and a biased layer, wherein the biased layer comprises carbon fibers having a modulus of elasticity of not less than 40 t/mm$^2$, and wherein the ratio of the number of turns of a prepreg sheet for forming the biased layer in the tip-end portion to that in the butt-end portion of the shaft ranges between 3:1 and 3:2.

3. The golf club shaft according to claim 1, wherein the shaft comprises a longitudinal layer and a biased layer, wherein the biased layer comprises carbon fibers having a modulus of elasticity of 40 t/mm$^2$ to 46 t/mm$^2$, and wherein the ratio of the number of turns of a prepreg sheet for forming the biased layer in the tip-end portion to that in the butt-end portion of the shaft ranges between 3:1 and 2:1.

4. The golf club according to claim 1, wherein the length of the shaft ranges between 42.5 inches to 44.5 inches.

5. The golf club according to claim 4, wherein the torque of the shaft ranges between 4.0 to 4.5 degrees.

6. The golf club according to claim 1, wherein the center of gravity of the shaft is located within 47.0 to 48.0% of its entire length from its tip end.

* * * * *